US008166698B2

(12) United States Patent
Raviv et al.

(10) Patent No.: US 8,166,698 B2
(45) Date of Patent: May 1, 2012

(54) REFLEX SIGHT FOR WEAPON

(76) Inventors: Roni Raviv, Nes Ziona (IL); Liran Ganor, Even-Yehuda (IL); Gil Limonchik, Gaithersburg, MD (US)

( * ) Notice: Subject to any disclaimer, the term of this patent is extended or adjusted under 35 U.S.C. 154(b) by 306 days.

(21) Appl. No.: 12/540,407

(22) Filed: Aug. 13, 2009

(65) Prior Publication Data

US 2011/0035980 A1 Feb. 17, 2011

(51) Int. Cl.
*F41G 1/30* (2006.01)

(52) U.S. Cl. ..... 42/131; 42/113

(58) Field of Classification Search ..... 42/113, 42/130, 131

See application file for complete search history.

(56) References Cited

U.S. PATENT DOCUMENTS

| | | | | |
|---|---|---|---|---|
| 4,145,952 | A * | 3/1979 | Tye | 89/41.21 |
| 5,303,495 | A * | 4/1994 | Harthcock | 42/84 |
| 5,483,362 | A * | 1/1996 | Tai et al. | 359/1 |
| 5,901,452 | A * | 5/1999 | Clarkson | 42/131 |
| 7,685,760 | B1 * | 3/2010 | Neumaster | 42/129 |

* cited by examiner

*Primary Examiner* — Stephen M Johnson

(74) *Attorney, Agent, or Firm* — Dekel Patent Ltd.; David Klein

(57) ABSTRACT

A weapons reflex sight including a display substrate mounted on a weapon, and an optics module, disposed in a housing, the optics module including a computer-generated imagery (CGI) system and optical elements for generating images and projecting a beam of the images on the display substrate, the images including an aimpoint for aiming at a target and information related to use of the weapon.

9 Claims, 4 Drawing Sheets

REFLEX SIGHT FOR WEAPON

FIELD OF THE INVENTION

The present invention relates generally to reflex sights for weapons (e.g., rifles or handguns), and particularly to a reflex sight with a dynamic information display.

BACKGROUND OF THE INVENTION

Reflex sights for weapons are well known in the art. Such sights use an image of a reticle reflected from a semi-transparent mirror surface, through which mirror the shooter views the target. Optics cause the reticle image to appear at or near infinity, parallax free, and in focus with the target. The optics may be a refracting lens in the system that collimates the reticle image. The mirror surface may be concave so that it collimates the reticle image as it reflects it. The sight magnification is 1× unity.

"Heads-Up Display" (HUD) reflex sights are known for use on weapons. The HUD or reflex sight is made up of an optical collimating reflector, mechanical adjustments and packaging, and an electronic light source. Conventional optical methods for collimating and reflecting the aimpoint to the eye use very basic classical optics. Generally, the reflex sights are one or two element off-axis reflectors with cover windows to zero the optical power of the scene (near unity 1× magnification) and/or provide environmental seals. The optical power of the see-through scene is normally non-adjustable. The optics may be able to change the virtual image of the reticle (i.e., the focal distance) in order to place the image at infinity or any other desired distance.

To combine the aimpoint wavefront with the scene, the typical reflex sight uses a partially mirrored coating or, for more efficiency, a multilayer dielectric dichroic coating, which reflects a narrow wave length of the reticle's image color (e.g., a red or green aimpoint) and transmits the visible spectrum of the scene. The hologram relies on diffraction to bring the colored aimpoint into the scene. Such reflex sights are mentioned in U.S. Pat. No. 5,901,452 to Clarkson, the disclosure of which is incorporated herein by reference.

SUMMARY OF THE INVENTION

The present invention seeks to provide a reflex sight with a dynamic information display, as is described more in detail hereinbelow.

There is thus provided in accordance with an embodiment of the present invention apparatus including a weapons reflex sight including a display substrate mountable on a weapon, and an optics module, disposed in a housing, the optics module including a computer-generated imagery (CGI) system and optical elements for generating images and projecting a beam of the images on the display substrate, the images including an aimpoint for aiming at a target and information related to use of the weapon.

In accordance with an embodiment of the present invention the optics module displays and focuses the image of the aimpoint at infinity. The optics module may display and focus the image of the information at a virtual distance less than infinity.

Further in accordance with an embodiment of the present invention the optics module includes a first light source for generating the image of the aimpoint and a second light source for generating the image of the information, and the optics module displays and focuses the image of the aimpoint at infinity and displays and focuses the image of the information at a virtual distance less than infinity.

In accordance with an embodiment of the present invention the optics module is in operative communication with a shot counter of the weapon and the information includes a number of shots fired or a number of rounds left in the weapon Additionally or alternatively, the shot information may include the total rounds fired since or during a particular reference time, such as for the purpose of service and wear issues. The optics module may be in operative communication with an ambient light detector and the optics module may include circuitry for controlling brightness of the images displayed on the display substrate in accordance with information from the ambient light detector.

The optics module may be in operative communication with a global positioning system (GPS) and the information may include information based on the GPS. The optics module may be in operative communication with a compass and the information may include information based on the compass. The optics module may be in operative communication with an inclination sensor and the information may include information based on the inclination sensor. The optics module may be in operative communication with an antenna for wireless communication of data.

There is also provided in accordance with an embodiment of the present invention a weapons reflex sight including a display substrate mounted on a weapon, and an optics module, disposed in a housing, the optics module including a computer-generated imagery (CGI) system and optical elements for generating images and projecting a beam of the images on the display substrate, the images including an aimpoint for aiming at a target and information related to use of the weapon.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Reference is now made to FIGS. 1-7, which illustrate various features of a weapons reflex sight 10, in accordance with an embodiment of the present invention.

Figure 3:
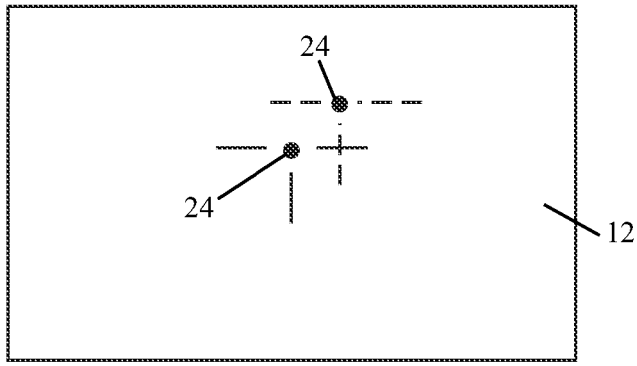
FIG. 3 is a simplified pictorial illustration of aimpoints displayed with the reflex sight, in accordance with an embodiment of the present invention, showing adjustable or calibratable aimpoints.
Figure 4A:
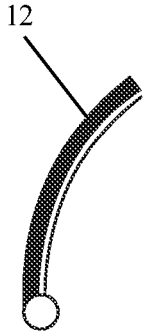
FIGS. 4A, 4B and 4C are simplified pictorial illustrations of the display substrate of the reflex sight, respectively showing two different surfaces in a folded up orientation and the display substrate in a folded down orientation.
Figure 4B:
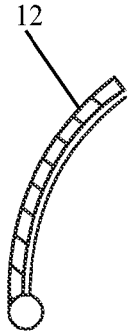
Figure 4C:
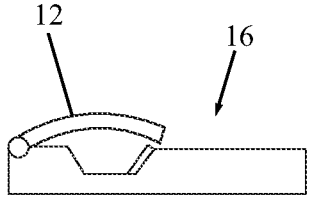

Reflex sight 10, which is mountable on a weapon 14, includes a display substrate 12 mounted on an optics module 16, which is disposed in a housing 18. Optics module 16 may include a computer-generated imagery (CGI) system 20 and suitable optical elements (lenses, mirrors, filters, LCD, OLED, LED etc.) for generating images and projecting a beam 22 of the images on display substrate (also called display screen) 12. It is noted that optics module 16 may include the display screen 12; the module has the optical power capacity to generate the virtual image. As is explained further below, the images include an aimpoint 24 for aiming at a target and information 26 related to use of the weapon 14. As seen in FIG. 3, the position of the aimpoint 24 may be adjusted, such as by commands from the optics module 16.

Housing 18 may be constructed, without limitation, of a rigid plastic. The display substrate 12 may be constructed, without limitation, of optical-grade injected-molded polycarbonate, which is very suitable for mass production. Thus display substrate 12 may be a low-cost, mass-produced, injected-molded reflective lens, which may be aspheric for low image distortion and miniaturization. As is well known in the art, display substrate 12 may be transparent, semi-transparent, or opaque, and may comprise a monochromatic or multichromatic reflective substrate or may be coated with a thin film coating, such as a dichroic coating, on a front or rear surface thereof (different coatings being shown in FIGS. 4A and 4B). Multilayer thin film coatings may be used for optimal contrast and brightness on injected molded polycarbonate lenses (or other suitable materials) in varying ambient light conditions. The chromatic selective mirror can also be formed with other methods, such as but not limited to, defractive holographic, micro or other such methods.

The optics module preferably displays and focuses the image of the aimpoint 24 at infinity (that is, "infinity virtual distance"), which is the distance at which the viewing eye sees the object with relaxed focus. This distance may be 20 m or more. For short range hand guns this distance may be smaller.

Figure 5A:
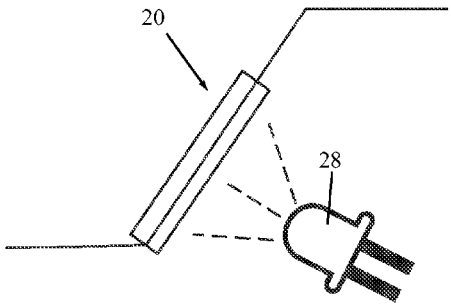
FIGS. 5A and 5B are simplified pictorial illustrations, respectively, of a single light source and double light source for generating images of the aimpoint and information to be displayed, in accordance with an embodiment of the present invention.

As seen in FIG. 5A, a single light source 28 (e.g., an LED) can be used for generating images of the aimpoint 24 and information 26 to be displayed. In this manner, a single display with a back light LCD with back lighting (which can be an array of several LED's for more intensity) generates both the reticle and the data information.

Figure 5B:
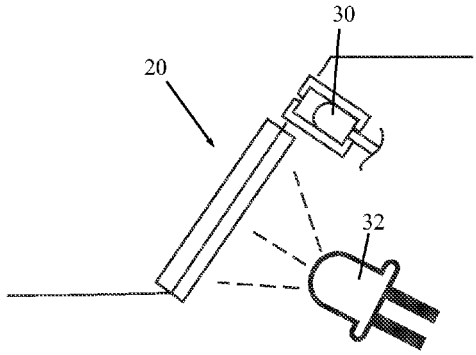
Figure 6:
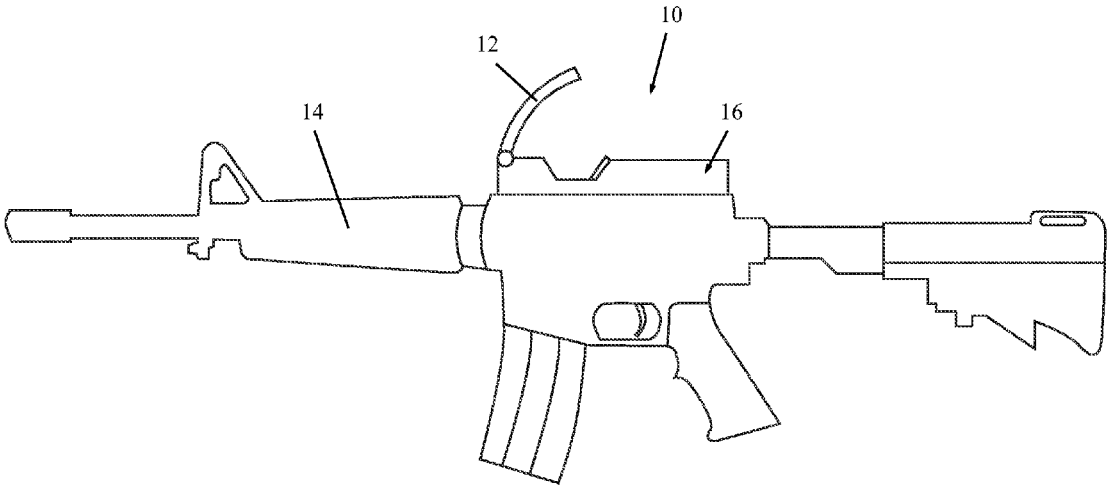
FIG. 6 is a simplified pictorial illustration of a weapon with the reflex sight, constructed and operative in accordance with an embodiment of the present invention.
Figure 7:
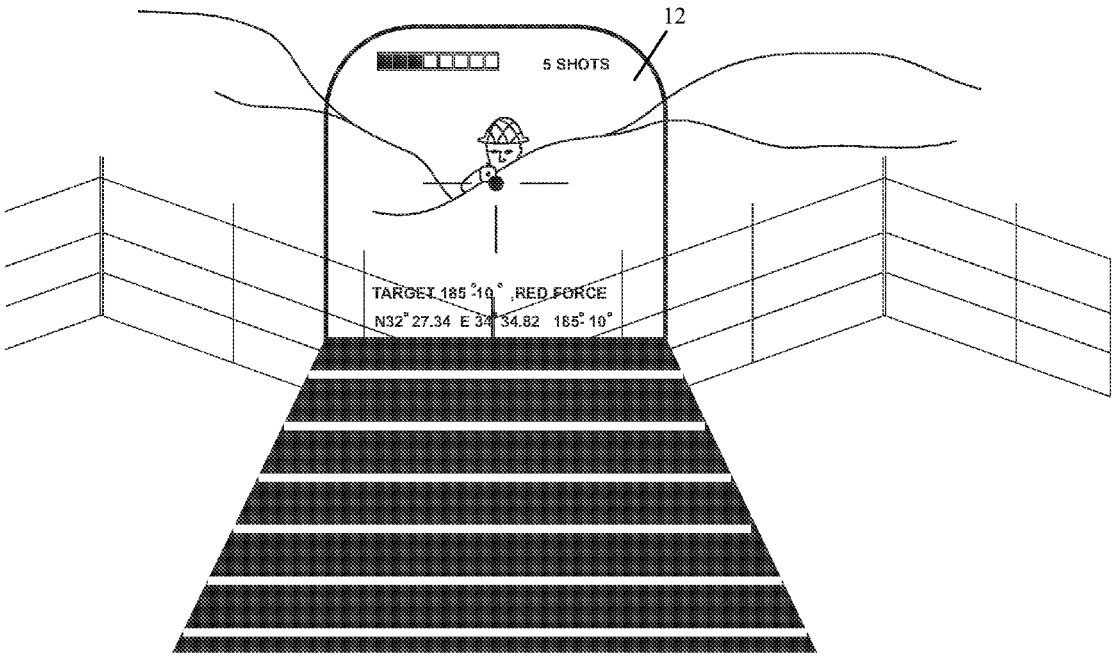
FIG. 7 is a simplified pictorial illustration of the display substrate displaying the aimpoint and information related to use of the weapon, in accordance with an embodiment of the present invention.

In accordance with another embodiment of the present invention, as seen in FIG. 5B, optics module 16 includes a first light source 30 for generating the image of the aimpoint and a second light source 32 for generating the image of the information. In this manner, the optics module 16 displays and focuses the image of the aimpoint 24 at infinity and displays and focuses the image of the information 26 at a virtual distance less than infinity, which makes the information significantly more readable for most users. This arrangement can help reduce or eliminate a problem of mixed attention for the shooter when aiming or reading the information by purposely focusing on the text/graphics.

Figure 1:
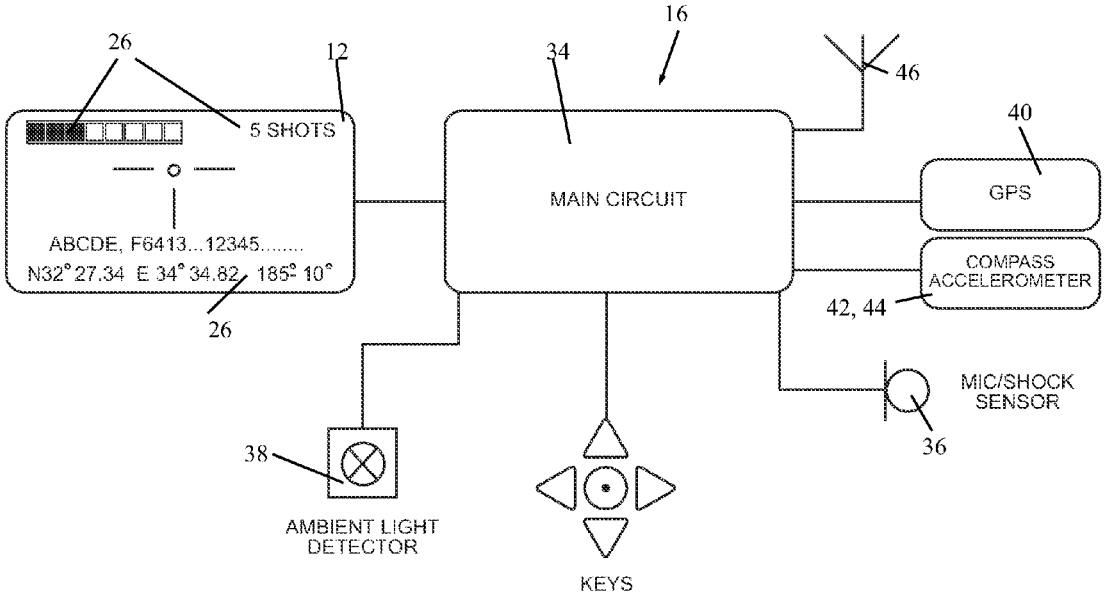
FIG. 1 is a simplified block diagram of a weapons reflex sight, in accordance with an embodiment of the present invention.
Figure 2:
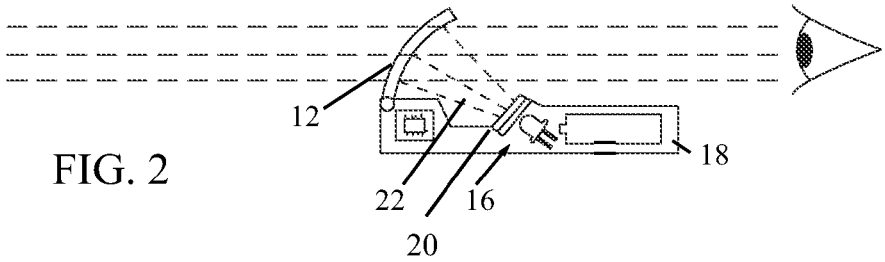
FIG. 2 is a simplified pictorial illustration of an optics module and display substrate of the reflex sight, constructed and operative in accordance with an embodiment of the present invention.

Reference is made particularly to FIG. 1. In accordance with an embodiment of the present invention, optics module 16 comprises circuitry 34 which is in operative communication with a shot counter 36 of the weapon. The shot counter 36 can be a microphone or shock sensor or any other electronic or mechanical shot counter used in the art. The information from the shot counter displayed on display substrate 12 may include a number of shots fired or a number of rounds left in the weapon or cumulative number of shots, as well as total shots to show the service life of the weapon.

The optics module 16 may be in operative communication with an ambient light detector 38. Circuitry 34 may control brightness of the images displayed on display substrate 12 in accordance with information from ambient light detector 38.

The optics module 16 may be in operative communication with a global positioning system (GPS) 40 and the information displayed on display substrate 12 may include information based on the GPS.

The optics module 16 may be in operative communication with a compass 42 or inclination sensor 44 (e.g., an accelerometer) and the information displayed on display substrate 12 may include information based on the compass or inclination sensor.

The optics module 16 may be in operative communication with an antenna 46 for wireless communication of data. Such data may be of military in nature, such as seen in the display shown in FIG. 7. Accordingly, reflex sight 10 allows the user to see visual data before, during and after shooting. Displayed data may include, without limitation, alerts and incoming messages like SMS and full text messages.

The invention may also be used to display many other kinds of information to the shooter in the reflex sight, such as but not limited to, weather, navigation, etc. One particular kind of useful information may be a shot locator where the direction of the sound of a shot fired is displayed on the display to help the viewer to locate such threat.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Apparatus comprising:

a weapons reflex sight mountable on a weapon, said reflex sight comprising a display substrate and an optics module, said optics module comprising a computer-generated imagery (CGI) system and optical elements for generating images and projecting a beam of said images on said display substrate, said images comprising an aimpoint for aiming at a target and changeable information, wherein said optics module comprises a first light source for generating said image of said aimpoint and a second light source for generating said image of said information, and said optics module displays and focuses said image of said aimpoint at infinity and displays and focuses said image of said information at a virtual distance less than infinity.

2. The apparatus according to claim 1, wherein said optics module is in operative communication with a shot counter of the weapon and said information comprises a number of shots fired or a number of rounds left in the weapon or cumulative number of shots.

3. The apparatus according to claim 1, wherein said optics module is in operative communication with an ambient light detector and said optics module comprises circuitry for controlling brightness of the images displayed on said display substrate in accordance with information from said ambient light detector.

4. The apparatus according to claim 1, wherein said optics module is in operative communication with a global positioning system (GPS) and said information comprises information based on said GPS.

5. The apparatus according to claim 1, wherein said optics module is in operative communication with a compass and said information comprises information based on said compass.

6. The apparatus according to claim 1, wherein said optics module is in operative communication with an inclination sensor and said information comprises information based on said inclination sensor.

7. The apparatus according to claim 1, wherein said optics module is in operative communication with an antenna for wireless communication of data.

8. A weapon assembly comprising:

a weapons reflex sight mounted on a weapon, said reflex sight comprising a display substrate and an optics module, said optics module comprising a computer-generated imagery (CGI) system and optical elements for generating images and projecting a beam of said images on said display substrate, said images comprising an aimpoint for aiming at a target and changeable information, wherein said optics module comprises a first light source for generating said image of said aimpoint and a second light source for generating said image of said information, and said optics module displays and focuses said image of said aimpoint at infinity and displays and focuses said image of said information at a virtual distance less than infinity.

9. The weapon assembly according to claim 8, wherein said optics module is in operative communication with a shot counter of the weapon and said information comprises a number of shots fired or a number of rounds left in the weapon.

* * * * *